US005178786A

United States Patent [19]

Jahnke et al.

[11] Patent Number: 5,178,786

[45] Date of Patent: Jan. 12, 1993

[54] CORROSION-INHIBITING COMPOSITIONS AND FUNCTIONAL FLUIDS CONTAINING SAME

[75] Inventors: Richard W. Jahnke, Mentor; Theodore O. Johnson, Chardon; Paul E. Adams, Willoughby Hills; John W. Forsberg, Mentor, all of Ohio

[73] Assignee: The Lubrizol Corporation, Wickliffe, Ohio

[21] Appl. No.: 389,642

[22] Filed: Aug. 4, 1989

[51] Int. Cl.[5] ..... C09K 5/00

[52] U.S. Cl. ..... 252/77; 252/74; 252/73; 252/79; 252/396; 252/394; 252/392; 252/49.3

[58] Field of Search ..... 252/396, 390, 392, 394, 252/388, 77, 79, 74, 73, 49.3, 49.5; 106/14.16, 14.18

[56] References Cited

U.S. PATENT DOCUMENTS

| | | | |
|---|---|---|---|
| 1,810,946 | 6/1931 | Calcott et al. . | |
| 2,790,779 | 4/1957 | Spivack et al. | 252/392 |
| 2,851,345 | 9/1958 | Marsh et al. | 44/71 |
| 2,926,108 | 2/1960 | Andersen | 117/127 |
| 2,931,700 | 4/1960 | Oakes | 21/2.7 |
| 3,034,907 | 5/1962 | Kleemann et al. | 106/14 |
| 3,046,225 | 7/1962 | Murray et al. | 252/33.6 |
| 3,116,252 | 12/1963 | Bevetvas | 252/51.5 |
| 3,206,399 | 9/1965 | Davis et al. | 252/40.5 |
| 3,469,955 | 9/1969 | Grosse-Oetringhaus | 44/63 |
| 3,712,918 | 1/1973 | Dudzinski et al. | 260/501.11 |
| 3,766,068 | 10/1973 | Tesdahl et al. | 252/33.2 |
| 3,787,227 | 1/1974 | Marans | 117/75 |
| 3,846,419 | 11/1974 | Seeliger et al. | 252/394 |
| 3,966,619 | 6/1976 | Smith et al. | 252/32.5 |
| 4,113,498 | 9/1978 | Rones et al. | 106/14.13 |
| 4,153,566 | 5/1979 | Ryer et al. | 252/51.5 A |
| 4,157,243 | 6/1979 | Ryer et al. | 252/392 |
| 4,224,172 | 9/1980 | Schmitt et al. | 252/51.5 R |
| 4,238,350 | 12/1980 | Larsen et al. | 252/392 |
| 4,273,664 | 6/1981 | Brandolese | 252/49.5 |
| 4,313,837 | 2/1982 | Vukasovich et al. | 252/49.5 |
| 4,326,987 | 4/1982 | Hendricks et al. | 252/392 |
| 4,470,918 | 9/1984 | Mosier | 252/77 |
| 4,561,990 | 12/1985 | Darden | 252/75 |
| 4,587,025 | 5/1986 | Horodysky et al. | 252/34 |
| 4,702,854 | 10/1987 | Snyder, Jr. et al. | 252/75 |
| 4,708,753 | 11/1987 | Forsberg | 149/2 |
| 4,806,256 | 2/1989 | Rose et al. | 252/71 |
| 4,859,354 | 8/1989 | Phillips et al. | 252/47.5 |
| 4,919,833 | 4/1990 | Miles | 252/77 |
| 4,938,891 | 7/1990 | Lenack et al. | 252/49.3 |
| 4,946,616 | 8/1990 | Falla et al. | 252/75 |
| 4,957,645 | 9/1990 | Emert et al. | 252/47.5 |

FOREIGN PATENT DOCUMENTS 809001 2/1959 United Kingdom .

*Primary Examiner*—Prince Willis, Jr.
*Assistant Examiner*—J. Silbermann
*Attorney, Agent, or Firm*—Forrest L. Collins; Frederick D. Hunter; John H. Englemann

[57] ABSTRACT

The invention provides a composition comprising:

(A) at least one dicarboxylic acid or anhydride or at least one ammonium or metal salt of the dicarboxylic acid or anhydride; and (B) at least one compound represented by the formula

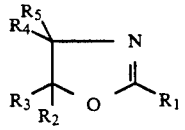

wherein $R_2$, $R_3$, $R_4$ and $R_5$ are each independently hydrogen, alkyl, hydroxyalkyl, polyhydroxyalkyl, polyalkoxyalkyl or hydroxypolyalkoxyalkyl; and $R_1$ is a hydrocarbyl group. In another embodiment, the compositions include (C) at least one acid, or ammonium or metal salt of the acid represented by the formula:

(II)

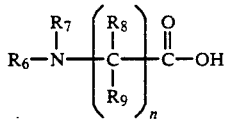

wherein $R_6$, $R_7$, $R_8$ and $R_9$ are each independently hydrogen or hydrocarbyl groups; and n is a number from 1 to about 10;

(D) at least one ester-salt derived from at least alkyl or alkenyl succinic acid or anhydride of about 8 to about 28 carbon atoms and at least one alkanol amine;

or mixtures of (C) and (D).

The invention further provides for concentrates and functional fluids containing the above corrosion-inhibitors.

47 Claims, No Drawings

CORROSION-INHIBITING COMPOSITIONS AND FUNCTIONAL FLUIDS CONTAINING SAME

FIELD OF THE INVENTION

This invention relates to corrosion-inhibiting compositions and their use in functional fluids. More specifically, this invention relates to the use of corrosion-inhibiting compositions in aqueous hydraulic fluids.

BACKGROUND OF THE INVENTION

Systems employing water-based functional fluids commonly have problems resulting from the corrosion of metal components. Corrosion occurs on ferrous-type metals as well as other metals within the system. Commonly, corrosion-inhibitors are used in the functional fluid to cure these corrosion problems.

When corrosion-inhibitors are used in functional fluids, the corrosion-inhibitors may act to decrease the stability of the fluid. Instability of the functional fluid may be described as a separation of the components of the fluid, e.g. a break in the dispersion. Care must be taken to balance corrosion-inhibiting properties versus fluid stability. Fluid stability is particularly troublesome in areas having hard water in the range of greater than 100 PPM. Commonly the water used in the functional fluid is supplied from the area surrounding the system where the functional fluid will be used. For instance, a fluid for a mining application will often be prepared using the water from the mine. This water often has a high degree of hardness, sometimes greater than 200 ppm.

It is desirable to have corrosion-inhibitors that prevent corrosion of metals within the system without detrimentally affecting fluid stability. It is particularly desirous to have corrosion-inhibitors which work in hard water.

SUMMARY OF THE INVENTION

The invention provides a composition comprising:

(A) at least one dicarboxylic acid or anhydride or ammonium or metal salt of the dicarboxylic acid or anhydride; and (B) at least one compound represented by the formula

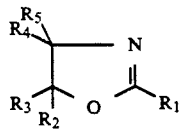

(I)

wherein $R_2$, $R_3$, $R_4$ and $R_5$ are each independently hydrogen, alkyl, hydroxyalkyl, polyhydroxyalkyl, polyalkoxyalkyl or hydroxypolyalkoxyalkyl; and $R_1$ is a hydrocarbyl group. In another embodiment, the compositions include (C) at least one acid, or ammonium or metal salt of the acid represented by the formula:

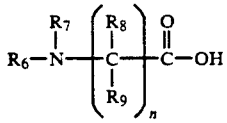

(II)

wherein $R_6$, $R_7$, $R_8$ and $R_9$ are each independently hydrogen or hydrocarbyl groups; and n is a number from 1 to about 10;

(D) at least one ester-salt derived from at alkyl or alkenyl succinic acid or anhydride of about 8 to about 28 carbon atoms and at least one alkanol amine; or mixtures of (C) and (D).

In one embodiment corrosion-inhibitors which afford hard water tolerance are provided In another embodiment functional fluids which are useful in long wall mining applications are provided.

DETAILED DESCRIPTION OF THE INVENTION

This invention is not limited to the particular compounds or processes described, as such compounds and methods may, of course, vary The terminology used herein is for the purpose of describing particular embodiments only, and is not intended to be limiting since the scope of the present invention will be limited only by the appended claims.

As used in this specification and the appended claims, the singular forms "a", "an" and "the" include plural referents unless the context clearly dictates otherwise. Thus, for example, reference to "a dicarboxylic acid" includes mixtures of acids, reference to "oxazoline" includes reference to mixtures of such oxazolines, and so forth.

The term "hydrocarbyl" includes hydrocarbon, as well as substantially hydrocarbon, groups. Substantially hydrocarbon describes groups which contain non-hydrocarbon substituents which do not alter the predominately hydrocarbon nature of the group.

Examples of hydrocarbyl groups include the following:

(1) hydrocarbon substituents, that is, aliphatic (e.g., alkyl or alkenyl), alicyclic (e.g., cycloalkyl, cycloalkenyl) substituents, aromatic-, aliphaticand alicyclic-substituted aromatic substituents and the like as well as cyclic substituents wherein the ring is completed through another portion of the molecule (that is, for example, any two indicated substituents may together form an alicyclic radical);

(2) substituted hydrocarbon substituents, that is, those substituents containing non-hydrocarbon groups which, in the context of this invention, do not alter the predominantly hydrocarbon substituent; those skilled in the art will be aware of such groups (e.g., halo (especially chloro and fluoro), hydroxy, alkoxy, mercapto, alkylmercapto, nitro, nitroso, sulfoxy, etc.);

(3) hetero substituents, that is, substituents which will, while having a predominantly hydrocarbon character within the context of this invention, contain other than carbon present in a ring or chain otherwise composed of carbon atoms. Suitable heteroatoms will be apparent to those of ordinary skill in the art and include, for example, sulfur, oxygen, nitrogen and such substituents as, e.g., pyridyl, furyl, thienyl, imidazolyl, etc. In general, no more than about 2, preferably no more than one, non-hydrocarbon substituent will be present for every ten carbon atoms in the hydrocarbyl group. Typically, there will be no such non-hydrocarbon substituents in the hydrocarbyl group. Therefore, the hydrocarbyl group is purely hydrocarbon.

COMPONENT (A)

The dicarboxylic acid or anhydride of the present invention is a saturated or unsaturated aliphatic or aromatic acid or anhydride. The saturated aliphatic cicarboxylic acid or anhydride preferably contains from 4 to about 24 carbon atoms, more preferably about 6 to about 18 carbon atoms In determining carbon atom ranges for the dicarboxylic acids or anhydrides, the carbon ranges are inclusive of carboxylic carbons For instance, dodecandioic acid has 12 carbon atoms In one embodiment, the saturated aliphatic dicarboxylic acids or anhydrides of the present invention are alpha, omega-dicarboxylic acids or anhydrides. Examples of saturated aliphatic dicarboxylic acids or anhydrides include hexanedioic, heptanedioic, octanedioic, decanedioic and dodecanedioic acid or anhydride. A useful dicarboxylic acid is dodecanedioic acid.

The unsaturated aliphatic dicarboxylic acids or anhydrides preferably contain from about 8 to about 28 carbon atoms, more preferably from about 12 to about 26 carbon atoms, more preferably from about 16 to about 22. Examples of the unsaturated aliphatic dicarboxylic acid or anhydride include octenedioic, decenedioic, dodecenedioic, hexadecenedioic and octadecenedioic acid or anhydride.

In one embodiment, dicarboxylic acids or anhydrides are prepared by the reaction of an olefin or a halogenated olefin with an alpha, beta unsaturated dicarboxylic acid or anhydride such as maleic or fumaric acid or anhydride, preferably maleic anhydride. The olefin preferably contains from about 4 to about 24 carbon atoms, more preferably from about 8 to about 22 carbon atoms. Examples of olefins include octene, decene, hexadecene, octadecene, etc. The olefin may be in the form of a commercial mixture. Commercial mixtures include predominately straight chain $C_{15-18}$ alpha-olefin mixtures; predominantly straight-chain $C_{15-20}$ alpha-olefin mixtures; predominantly straight-chain $C_{16-18}$ alpha-olefin mixtures; and predominantly vinyl and vinylidene $C_{18-24}$ alpha-olefin mixtures. The olefins include oligomers, such as propylene tetramer. Monomers useful in making the oligomers include, but are not limited to, ethylene, butylene, propylene, etc.

The reaction of the olefin with the alpha, beta-unsaturated dicarboxylic acid or anhydride preferably occurs at a temperature of about 75° C. to about 250° C., more preferably from 125° C. to about 225° C. The reaction may occur between an olefin or a halogenated olefin. The halogenated olefin can be prepared by the reaction of a halogen gas, preferably chlorine, with an olefin at a temperature in the range of about 100° C. to about 250° C. using known procedures.

Aromatic dicarboxylic acids or anhydrides may contain one or more aromatic rings. Preferably, the aromatic dicarboxylic acids or anhydrides contain from one or two aromatic rings, with one aromatic ring being preferred. These acids or anhydrides preferably contain from 6 to about 24 carbon atoms, more preferably 6 to about 18 carbon atoms Examples of aromatic dicarboxylic acids or anhydrides useful in the present invention include methylisophthalic acid, terephthalic acid, phthalic acid or anhydride, isophthalic acid, etc.

Mixtures of two or more of the saturated or unsaturated aliphatic or aromatic dicarboxylic acids or anhydrides can be used.

The ammonium salts of the acid represented by Formula II are prepared from ammonia, monoamines, or polyamines.

The monoamines preferably contain from 1 to about 24 carbon atoms, with 1 to about 12 carbon atoms being more preferred Examples of monoamines useful in the present invention include methylamine, ethylamine, propylamine, butylamine, octylamine, and dodecylamine. The above list also includes secondary and tertiary forms of the monoamines. For instance, methylamine is meant to encompass methylamine, dimethylamine and trimethylamine.

In another embodiment the amines are hydroxyamines. Typically, the hydroxyamines are primary, secondary or tertiary alkanol amines or mixtures thereof. Such amines can be represented, respectfully, by the formulae:

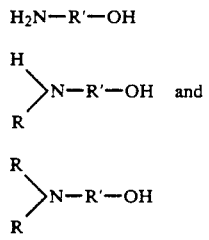

wherein each R is independently a hydrocarbyl group of one to about eight carbon atoms or hydroxyhydrocarbyl group of two to about eight carbon atoms and R′ is a divalent hydrocarbyl group of about two to about 18 carbon atoms. The group —R′—OH in such formulae represents the hydroxyhydrocarbyl group. R′ can be an acyclic, alicyclic or aromatic group. Typically, R′ is an acyclic straight or branched alkylene group such as an ethylene, 1,2-propylene, 1,2-butylene, 1,2-octadecylene, etc. group. where two R groups are present in the same molecule they can be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxylower alkyl)-morpholines, -thiomorpholines, -piperidines, -oxazolidines, -thiazolidines and the like. Typically, however, each R is a lower alkyl group of up to seven carbon atoms.

The hydroxyamines can also be an ether amine These ether amines are hydroxyl-substituted poly(hydrocarbyloxy) analogs of the above-described hydroxyamines (these analogs also include hydroxyl-substituted oxyalkylene analogs). Such ether amines can be conveniently prepared by reaction of epoxides with afore-described amines and can be represented by the formulae:

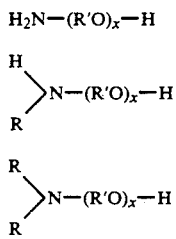

wherein x is a number from about 2 to about 15 and R and R′ are as described above R may be hydroxypoly(-hydrocarbyloxy).

The polyamines may be aliphatic, cycloaliphatic, heterocyclic or aromatic Examples of the polyamines include alkylene polyamines and heterocyclic polyamines.

Alkylene polyamines are represented by the formula

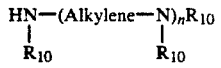

wherein n has an average value between about 1 and about 10, preferably about 2 to about 7 and the "Alkylene" group has from 1 to about 10 carbon atoms, preferably about 2 to about 6 carbon atoms. As noted above, $R_{10}$ is preferably an aliphatic or hydroxy-substituted aliphatic group of up to about 30 carbon atoms.

Such alkylene polyamines include methylene polyamines, ethylene polyamines, butylene polyamines, propylene polyamines, pentylene polyamines, etc. The higher homologs and related heterocyclic amines such as piperazines and N-amino alkyl-substituted piperazines are also included. Specific examples of such polyamines are ethylene diamine, triethylene tetramine, tris-(2-aminoethyl)amine, propylene diamine, trimethylene diamine, tripropylene tetramine, tetraethylene pentamine, hexaethylene heptamine, pentaethylenehexamine, etc.

Higher homologs obtained by condensing two or more of the above-noted alkylene amines are similarly useful as are mixtures of two or more of the afore-described polyamines.

Ethylene polyamines, such as some of those mentioned above, are useful Such polyamines are described in detail under the heading Ethylene Amines in Kirk Othmer's "Encyclopedia of Chemical Technology", 2d Edition, Vol. 7, pages 22-37, Interscience Publishers, New york (1965). Such polyamines are most conveniently prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products such as the afore-described piperazines. Ethylene polyamine mixtures are useful Polyamine analogs of the hydroxymonoamines, particularly alkoxylated alkylene polyamines (e.g., N,N-(diethanol)-ethylene diamine) can also be used Such polyamines can be made by reacting alkylene amines (e.g., ethylenediamine) with one or more alkylene oxides (e.g., ethylene oxide, octadecene oxide) of two to about 20 carbons Similar alkylene oxide-alkanol amine reaction products can also be used such as the products made by reacting the afore-described primary, secondary or tertiary alkanol amines with ethylene, propylene or higher epoxides in a 1.1 to 1.2 molar ratio. Reactant ratios and temperatures for carrying out such reactions are known to those skilled in the art.

Specific examples of alkoxylated alkylene polyamines include N-(2-hydroxyethyl) ethylene diamine, N,N-bis(2-hydroxyethyl)-ethylene-diamine, 1-(2-hydroxyethyl) piperazine, mono(hydroxypropyl)-substituted tetraethylene pentamine, N-(3-hydroxybutyl)-tetramethylene diamine, etc. Higher homologs obtained by condensation of the above-illustrated hydroxyalkylene polyamines through amino groups or through hydroxy groups are likewise useful. Condensation through amino groups results in a higher amine accompanied by removal of ammonia while condensation through the hydroxy groups results in products containing ether linkages accompanied by removal of water. Mixtures of two or more of any of the aforesaid polyamines are also useful.

Among the heterocyclic polyamines are aziridines, azetidines, azolidines, tetra- and dihydropyridines, pyrroles, indoles, piperidines, imidazoles, diand tetrahydroimidazoles, piperazines, isoindoles, purines, morpholines, thiomorpholines, N-aminoalkylmorpholines, N-aminoalkylthiomorpholines, N-aminoalkylpiperazines, N,N'-diaminoalkylpiperazines, azepines, azocines, azonines, azecines and tetra-, di- and perhydro derivatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted piperazines, morpholine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminopropylmorpholine, N-aminoethylpiperazine, and N,N'-diaminoethylpiperazine.

Hydroxy heterocyclic polyamines are also useful. Examples include N-(2-hydroxyethyl)cyclohexylamine, 3-hydroxycyclopentylamine, parahydroxyaniline, N-hydroxyethylpiperazine, and the like.

The ammonium salts of the acids represented by Formula (II) may be prepared from ammonia or mono- or polyamines. These salts are usually prepared at a temperature of from about 30° C. to about 110° C., with about 30° C. to about 80° C. being preferred.

The metal salts of the acids represented by Formula (II) may be prepared by the reaction of the acid with an alkali, or an alkaline earth compound The alkali or alkaline earth metal compound are usually in the form of alkali or alkaline earth metal oxides, hydroxides, carbonates, sulfates, etc. Examples of alkali or alkaline compounds include sodium hydroxide or oxide, potassium hydroxide or oxide, calcium hydroxide or carbonate, etc. The reaction usually occurs at a temperature of from about 30° C. to about 150° C., with about 30° C. to about 125° C. being preferred. The acid is reacted with the metal compound in roughly stoichiometric amounts. It should be noted that a slight excess of metal-containing compound may be used.

The metal of the metal salts may be selected from the group consisting of sodium, potassium, lithium and magnesium. Sodium or potassium is the preferred metal.

Mixtures of amines or metals and mixtures of amines and metals are useful.

COMPONENT (B)

Component (B) comprises at least one compound represented by the formula

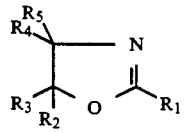

(I)

wherein $R_2$, $R_3$, $R_4$ and $R_5$ are each independently hydrogen, alkyl, hydroxyalkyl, polyhydroxyalkyl, polyalkoxyalkyl, or hydroxypolyalkoxyalkyl; and $R_1$ is a hydrocarbyl group.

In Formula I, $R_2$, $R_3$, $R_4$ and $R_5$ are preferably hydrogen, hydroxyalkyl, alkyl and hydroxy pOlyOxyalkyl, with hydrogen, hydroyxalkyl and alkyl being more preferred. $R_4$ and $R_5$ are more preferably ghydroxyalkyl while $R_2$ and $R_3$ are more preferably hydrogen $R_4$ and $R_5$ are more preferably hydroxymethyl groups.

When $R_2$, $R_3$, $R_4$ and $R_5$ are hydroxyalkyl, the alkyl portion of the group preferably contains from 1 to about 6 carbon atoms, preferably 1 to about 3 carbon atoms. When $R_2$, $R_3$, $R_4$ and $R_5$ are alkyl, they preferably contain from 1 to about 12 carbon atoms, more preferably 1 to about 6 carbon atoms. Examples include methyl, ethyl, propyl, butyl, octyl, and decyl.

In Formula I, $R_1$ can be aryl, alkenyl, alkyl, arylalkyl or alkylaryl. $R_1$ is preferably an alkenyl or alkyl group with an alkenyl group being more preferred. Examples of $R_1$ include, but are not limited to, octenyl, dodecenyl, decenyl, hexadecenyl, heptadecenyl, etc. $R_1$ preferably contains from 1 to about 28 carbon atoms, more preferably about 4 to about 22 carbon atoms, more preferably about 6 to about 20, and more preferably about 16 to about 18 carbon atoms.

The compounds represented by Formula (I) can be classified as oxazolines. These oxazolines can be formed by the reaction of a carboxylic acid with a 1,2-amino alcohol. The carboxylic acids and 1,2-amino alcohols useful to make the oxazolines of the present invention may be chosen by one of ordinary skill in the art by reference to Formula I and the teachings herein. Examples of carboxylic acids include hexanoic, octanoic, decanoic, dodecanoic, oleic, stearic, or linoleic acid. Oleic acid is particularly useful. Examples of 1,2 amino alcohols include 2-amino-1-butanol;
2-amino-1-ethanol;
2-amino-2-ethyl-1,3-propanediol;
2-amino-1-hexanol;
2-amino-2-hydroxymethyl-1,3-propanediol, (tris-hydroxymethyl-aminomethane or THAM);
2-amino-3-methyl-1-butanol;
2-amino-3-methyl-1-pentanol;
2-amino-2-methyl-1,3-propanediol;
2-amino-2-methyl-1-propanol;
2-amino-1-pentanol;
3-amino-1,2-propanediol; and
1-amino-2-propanol.

Preferred 1,2-aminoalcohols are 2-amino-2-hydroxymethyl-1,3-propandiol; 2-amino-2-ethyl-1,3-propanediol; and 2-amino-2-methy11,3-propanediol, with 2-amino-2-hydroxymethyl-1,3-propanediol (THAM) being particularly preferred.

The reaction between the carboxylic acid and 1,2-aminoalcohol can be conducted at about 100° C. to about 200° C. with about 125° C. to about 180° C. preferred. The formation of oxazolines is known to those skilled in

COMPONENT (C)

In another embodiment, the compositions of the present invention contain (C) at least one acid, or ammonium or metal salt of the acid represented by the formula:

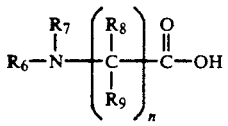

(II)

wherein $R_6$, $R_7$, $R_8$ and $R_9$ are each independently hydrogen or hydrocarbyl groups; and n is a number from 1 to about 10.

In Formula II, $R_6$ and $R_7$ are preferably hydrogen, alkyl containing from 1 to about 20 carbon atoms, more preferably about 4 to about 16 carbon atoms, and more preferably 1 to about 6 carbon atoms. In one embodiment $R_6$ and $R_7$ are preferably hydrogen, methyl, ethyl, butyl, or propyl.

In Formula II, $R_8$ and $R_9$ are each independently preferably hydrogen or alkyl containing from 1 to about 6 carbon atoms, more preferably 1 to about 3 carbon atoms. In one embodiment $R_8$ and $R_9$ are each independently methyl, ethyl or propyl.

In Formula II, n is 1–10, preferably 1–4, and more preferably 1.

The ammonium and metal salts of the acid represented by Formula II are prepared from amines and alkali or alkaline earth compounds described above for making the salts of the dicarboxylic acid or anhydrides. The descriptions of the amines and alkali or alkaline earth metal compound is hereby incorporated by reference.

In another embodiment, the acid of Formula II is in the form of a Zwitterion.

COMPONENT (D)

Component D is an ester-salt formed by the reaction of an alkyl or alkenyl succinic anhydride or acid having an alkyl or alkenyl group with from about 8 to about 28 carbon atoms with an alkanol amine. The alkyl or alkenyl group preferably has from about 10 to about 24 carbon atoms, with about 12 to about 22 carbon atoms most preferred. A particularly useful succinic anhydride is an alkyl or alkenyl succinic acid or anhydride having an alkenyl group which has from about 14 to about 18 carbon atoms, more preferably about 16 to about 18 carbon atoms, with a $C_{16-18}$ substituted succinic anhydride being preferred.

The alkanolamine may be any of the alkanolamines (hydroxyalkyl amines) described above for the ammonium salts of the acid represented by formula (II), that disclosure is incorporated. Tertiary alkanolamines are preferred. Preferred alkanolamines are represented by the formula (III)

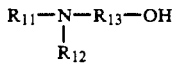

(III)

wherein $R_{11}$ and $R_{12}$ are each independently alkyl or hydroxyalkyl groups having from 1 to about 10 carbon atoms, preferably from 1 to about 6 carbon atoms, and more preferably from 1 to about 4 carbon atoms. $R_{13}$ is preferably an alkylene group having from 1 to about 10 carbon atoms, more preferably from 1 to about 4 carbon atoms, more preferably 2 or 3 carbon atoms.

Preferred alkanol amines include dimethylethanolamine, diethylethanolamine, methylethylethanolamine and the like.

The ester-salt is prepared by reacting the succinic anhydride or acid with the alkanol amine under conditions that lead to formation of an ester group. The nitrogen portion of the alkanolamine then forms an internal salt with the remaining carboxylic acid group on the succinic anhydride or acid. The salt may be formed from another amine or metal. The ester-salt may be a mixture of salts. A temperature range between about 30° C. and about 110° C. is normally sufficient. For instance, heat 276 parts $C_{16}$ succinic anhydride to 50° C. and add 89 parts of N,N-dimethylethanolamine. Allow the temperature to rise to 85° C.–90° C., providing heat if necessary. Maintain the temperature at 85° C.–90° C. for 3 hours.

In the compositions of the present invention, the ratio of (A):(B)is from (3:1) to about (1:3). The ratio of (B):(C) or (D) is from (3:1) to about (1:3). Preferably, when the composition contains (A), (B) or (C) or (D), they are each present in a ratio of 1:1:1.

FUNCTIONAL FLUIDS

The invention also includes functional fluid compositions characterized by water with components (A) and (B) dispersed in the water. The fluid may also contain component (C), (D) or mixtures of (C) and (D). The water-based functional fluids generally contain from about 0.005% to about 0.15% by weight of each of (A) and (B) or each of (A), (B) (C) or (D). The concentrates generally contain less than about 50%, preferably less than about 25%, more preferably less than about 15%, and still more preferably less than about 6% hydrocarbon oil. The water-based functional fluids generally contain less than about 15%, preferably less than about 5%, and more preferably less than about 2% oil. In another embodiment, the water-based functional fluid may contain no oil.

The functional fluids are preferably in the form of micelle dispersions or microemulsions. The fluids can be prepared simply by mixing the composition of the present invention, water, a dispersant, and any other ingredient which may be desirable, in a homogenizer or any other efficient blending device. Heating the fluid during or after it is prepared is not necessary. The order of mixing of the ingredients is not critical, although it is convenient first to prepare an oil concentrate containing from about 50 to 95 parts of oil and then to emulsify the concentrate with water in appropriate proportions.

The water of the emulsion is usually a hard water. Hard water is caused by the presence of alkalineearth salts, usually calcium or magnesium sulfates, chlorides or bicarbonates. Usually magnesium salts are expressed in terms of equivalent amounts of calcium oxide or carbonate. In the present invention the water hardness is defined as ppm of calcium carbonate. Hard water in this case is water having hardness in the range of greater than 100 ppm. Preferably the water will have a hardness of greater than 200 ppm, most preferably greater than 250 ppm. Usually the upper limit of the water hardness range is defined by the solubility of the salts. Typically the upper limit may be up to 3000 ppm, preferably up to about 2000 ppm. The water is commonly supplied from the surrounding area. For instance, the water supplied in a long wall mining application would be the water available in or near the mine location.

Oil, when present, may be a hydrocarbon oil having viscosity values from 50 SUS (Saybolt Universal Seconds) at 100° F. to 200 SUS at 210° F. Mineral oils having lubricating viscosities (e.g., SAE 5-90 grade oils) are especially advantageous for use in the emulsion. A mixture of oils of different sources likewise is useful. Such a mixture is available from mineral oils, vegetable oils, animal oils, synthetic oils of the silicon type, synthetic oils of the polyolefin type, synthetic oils of the polyester type, etc.

DISPERSANTS

The dispersant may be any material which will emulsify the compositions of the present invention. A single dispersant may be used but it is preferable to use two or more dispersants.

Dispersants useful in the present invention include alkoxylated amines; reaction products of alkyl or alkenyl substituted succinic anhydrides or acids with an amine; and acids such as tall oil acids and rosin acids.

Dispersants which are a reaction product of a succinic acid or anhydride with an amine are commonly in the form amides, imides, ester-salts, salts or mixtures of two or more thereof. These emulsifiers have been referred to as carboxylic stabilizers as well as dispersants. The alkyl or alkenyl succinic anhydride contains from about 12 to about 500 carbon atoms in the alkyl or alkenyl substituent, preferably about 20 to about 300 carbon atoms, most preferably about 50 to about 250 carbon atoms. These alkyl or alkenyl succinic anhydrides and acids are known in the art.

The succinic acid or anhydride is reacted with an amine. The amine may be selected from the group consisting of an alkyl amine, an alkanol amine, a alkylene amine, a hydroxypolyalkylene amine, and the like. The amine may be substituted as well as a primary amine. Amines used in the description of the ammonium salts of component (A) may be used to make the emulsifier. The disclosure of those amines is herein incorporated. Amines useful to make the dispersant described above are known to those in the art. The following U.S. patents are incorporated by reference for their disclosure of alkyl or alkenyl substituted succinic acids or anhydrides (1); amines (2) useful to react with (1); the reaction products (3) of (1) and (2); and the conditions to make (3): U.S. Pat. No. 4,329,249; U.S. Pat. No. 4,435,297; U.S. Pat. No. 4,368,133; U.S. Pat. No. 4,447,348; U.S. Pat. No. 4,448,703; U.S. Pat. No. 4,468,339; U.S. Pat. No. 4,666,620; U.S. Pat. No. 3,269,946; and U.S. Pat. No. 4,708,753.

In one embodiment the dispersant is the reaction product of a $C_{12-500}$ alkenyl succinic anhydride with an amine. The alkenyl succinic anhydride has a substituent which has a number average molecular weight between about 800 and about 1700, with about 900 to about 1500 preferred, and with about 900 to about 1200 being most preferred. The preferred amine is a tertiary hydroxy amine such as diethylethanol amine, the emulsifier is preferably in the form of an ester-salt. For instance, the hydroxy portion of the amine reacts with the succinic anhydride and the nitrogen portion of the alkanolamine forms the internal salt. The salt may be formed by another amine present during the reaction.

The alkoxylated amines of the present invention are primary or secondary amines which are reacted with an epoxide or aldehyde. Alkoxylated amines include polyalkoxylated amines. Preferred polyalkoxylated amines include polyethoxylated which include the polyoxyethylated amines, amides, and quaternary salts available from Akzona Incorporated under the names ETHODUOMEEN polyethoxylated high-molecular-weight aliphatic diamines; ETHOMEEN, polyethoxylated aliphatic amines containing alkyl groups in the range of about 8 to about 18 carbon atoms; ETHOMID, polyethoxylated high-molecular-weight amides; and ETHOQUAD, polyethoxylated quaternary ammonium chlorides derived from longchain amines.

The preferred alkoxylated amine is an ethoxylated cocoamine sold under the Trade Name Ethomeen C/25 (available from Akzona Incorporated).

The acids useful as dispersants are acids derived from tall oil acids The tall oil acid may be tall oil fatty acids which is a distilled mixture of acids comprising chiefly oleic and linoleic acid. Preferred tall oil acids are mixtures of rosin acids and fatty acids sold under the trade name Unitol DT/40 (available from Union Camp Corp).

In one embodiment of the invention the dispersant is a mixture of the reaction product of an alkyl or alkenyl succinic anhydride or acid with an amine, as described above, and a co-dispersant. The combination of these materials form useful microemulsions.

The co-dispersant may be the alkoxylated amines or acids described above as well as other dispersants which are commonly referred to as surfactants.

The surfactants that are useful in the aqueous compositions of the invention can be of the cationic, anionic, nonionic or amphoteric type. Many such surfactants of each type are known to the art. See, for example, McCutcheon's "Emulsifiers & Detergents", 1981, North American Edition, published by McCutoheon Division, MC Publishing Co., Glen Rock, N.J., U.S.A., which is hereby incorporated by reference for its disclosures in this regard.

Among the nonionic surfactant types are the alkylene oxide-treated products, such as ethylene oxide-treated phenols, alcohols, esters, amines and amides. Ethylene oxide/propylene oxide block copolymers are also useful nonionic surfactants. Glycerol esters and sugar esters are also known to be nonionic surfactants. A typical nonionic surfactant class useful with the present invention are the alkylene oxide-treated alkyl phenols such as the ethylene oxide alkyl phenol condensates sold by the Rohm & Haas Company. A specific example of these is Triton X-100 which contains an average of 9–10 ethylene oxide units per molecule, has an HLB value of about 13.5 and a molecular weight of about 628. Many other suitable nonionic surfactants are known; see, for example, the aforementioned McCutcheon's as well as the treatise "Non-Ionic Surfactants" edited by Martin J. Schick, M. Dekker Co., New York, 1967, which is herein incorporated by reference for its disclosures in this regard.

As noted above, cationic, anionic and amphoteric surfactants can also be used. Generally, these are all hydrophilic surfactants. Anionic surfactants contain negatively charged polar groups while cationic surfactants contain positively charged polar groups. Amphoteric dispersants contain both types of polar groups in the same molecule. A general survey of useful surfactants is found in Kirk-Othmer Encyclopedia of Chemical Technology, Second Edition, Volume 19, page 507 et seq. (1969, John Wiley and Son, New York) and the aforementioned compilation published under the name of McCutcheon's. These references are both hereby incorporated by reference for their disclosures relating to cationic, amphoteric and anionic surfactants.

Among the useful anionic surfactant types are the widely known carboxylate soaps, organo sulfates, sulfonates, sulfocarboxylic acids and their salts, and phosphates. Useful cationic surfactants include nitrogen compounds such as amine oxides and the well-known quaternary ammonium salts Amphoteric surfactants include amino acid-type materials and similar types Various cationic, anionic and amphoteric dispersants are available from the industry, particularly from such companies as Rohm & Haas and Union Carbide Corporation, both of America. Further information about anionic and cationic surfactants also can be found in the texts "Anionic Surfactants", Parts II and III, edited by W. M. Linfield, published by Marcel Dekker, Inc., New York, 1976 and "Cationic Surfactants", edited by E. Jungermann, Marcel Dekker, Inc., New York, 1976. Both of these references are incorporated by reference for their disclosures in this regard.

These surfactants, when used, are generally employed in effective amounts to aid in the dispersal of the various additives, particularly in the water-based functional fluids of the invention. Preferably, the concentrates can contain up to about 75% by weight, more preferably from about 10% to about 75% by weight of one or more of these surfactants. The water-based functional fluids can contain up to about 15% by weight, more preferably from about 0.05% to about 15% by weight of one or more of these surfactants.

THICKENER

Often the aqueous compositions of this invention contain at least one thickener. Generally, these thickeners can be polysaccharides, synthetic thickening polymers, or mixtures of two or more of these. Among the polysaccharides that are useful are natural gums such as those disclosed in "Industrial Gums" by Whistler and B. Miller, published by Academic Press, 1959. Disclosures in this book relating to water-soluble thickening natural gums is hereby incorporated by reference. Specific examples of such gums are gum agar, guar gum, gum arabic, algin, dextrans, xanthan gum and the like. Also among the polysaccharides that are useful as thickeners for the aqueous compositions of this invention are cellulose ethers and esters, including hydroxy hydrocarbyl cellulose and hydrocarbylhydroxy cellulose and its salts. Specific examples of such thickeners are hydroxyethyl cellulose and the sodium salt of carboxymethyl cellulose. Mixtures of two or more of any such thickeners are also useful.

It is a general requirement that the thickener used in the aqueous compositions of the present invention be soluble in both cold (10° C.) and hot (about 90° C.) water. This excludes such materials as methyl cellulose which is soluble in cold water but not in hot water. Such hot-water-insoluble materials, however, can be used to perform other functions such as providing lubricity to the aqueous compositions of this invention.

These thickeners can also be synthetic thickening polymers. Many such polymers are known to those of skill in the art. Representative of them are polyacrylates, polyacrylamides, hydrolyzed vinyl esters, water-soluble homo- and interpolymers of acrylamidoalkane sulfonates containing 50 mole percent at least of acryloamido alkane sulfonate and other comonomers such as acrylonitrile, styrene and the like. Poly-n-vinyl pyrrolidones, homo- and copolymers as well as water-soluble salts of styrene, maleic anhydride and isobutylene maleic anhydride copolymers can also be used as thickening agents.

Other useful thickeners are known to those of skill in the art and many can be found in the list in the aforementioned McCutcheon Publication: "Functional Materials," 1976, pp. 135–147, inclusive. The disclosures therein, relative to water-soluble polymeric thickening agents meeting the general requirements set forth above are hereby incorporated by reference.

Preferred thickeners, particularly when the compositions of the invention are required to be stable under high shear applications, are the water-dispersible reaction products formed by reacting at least one hydrocarbyl-substituted succinic acid and/or anhydride represented by the formula

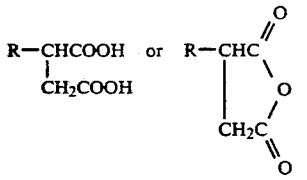

wherein R is a hydrocarbyl group of from about 8 to about 40 carbon atoms, with at least one water-dispersible amine terminated poly(oxyalkylene) or at least one water-dispersible hydroxy-terminated polyoxyalkylene. R preferably has from about 8 to about 30 carbon atoms, more preferably from about 12 to about 24 carbon atoms, still more preferably from about 16 to about 18 carbon atoms. In a preferred embodiment, R is represented by the formula

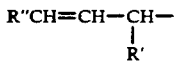

wherein R′ and R″ are independently hydrogen or straight chain or substantially straight chain hydrocarbyl groups, with the proviso that the total number of carbon atoms in R is within the above-indicated ranges. Preferably R′ and R″ are alkyl or alkenyl groups. In a particularly advantageous embodiment, R has from about 16 to about 18 carbon atoms, R′ is hydrogen or an alkyl group of from 1 to about 7 carbon atoms or an alkenyl group of from 2 to about 7 carbon atoms, and R″ is an alkyl or alkenyl group of from about 5 to about 15 carbon atoms.

The water-dispersible amine terminated poly(oxyalkylene)s are preferably alpha,omega diamino poly(oxyethylene)s, alpha,omega diamino poly(oxypropylene) poly(oxyethylene) poly(oxypropylene)s or alpha,omega diamino propylene oxide capped poly(oxyethylene)s. The amine-terminated poly(oxyalkylene) can also be a urea condensate of such alpha omega diamino poly(oxyethylene)s, alpha omega diamino poly(oxypropylene) poly(oxyethylene) poly(oxypropylene)s or alpha omega diamino propylene oxide capped poly(oxyethylene)s. The amineterminated poly(oxyalkylene) can also be a polyamino (e.g., triamino, tetramino, etc.) polyoxyalkylene provided it is amine-terminated and it is water-dispersible.

Examples of water-dispersible amine-terminated poly(oxyalkylene)s that are useful in accordance with the present invention are disclosed in U.S. Pat. Nos. 3,021,232; 3,108,011; 4,444,566; and Re 31,522. The disclosures of these patents are incorporated herein by reference. Water-dispersible amine terminated poly(oxyalkylene)s that are useful are commercially available from the Texaco Chemical Company under the trade name Jeffamine.

The water-dispersible hydroxy-terminated polyoxyalkylenes are constituted of block polymers of propylene oxide and ethylene oxide, and a nucleus which is derived from organic compounds containing a plurality of reactive hydrogen atoms. The block polymers are attached to the nucleus at the sites of the reactive hydrogen atoms. Examples of these compounds include the hydroxyterminated polyoxyalkylenes which are represented by the formula

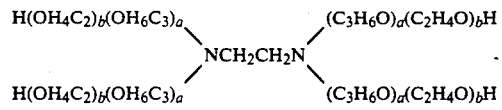

wherein a and b are integers such that the collective molecular weight of the oxypropylene chains range from about 900 to about 25,000, and the collective weight of the oxyethylene chains constitute from about 20% to about 90%, preferably from about 25% to about 55% by weight of the compound These compounds are commercially available from BASF Wyandotte Corporation under the tradename "Tetronic". Additional examples include the hydroxy-terminated polyoxyalkylenes represented by the formula

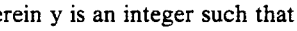

wherein y is an integer such that the molecular weight of the oxypropylene chain is at least about 900, and x and z are integers such that the collective weight of the oxyethylene chains constitute from about 20% to about 90% by weight of the compound. These compounds preferably have a molecular weight in the range of about 1100 to about 14,000. These compounds are commercially available from BASF Wyandotte Corporation under the tradename "Pluronic". Useful hydroxy-terminated polyoxyalkylenes are disclosed in U.S. Pat. Nos. 2,674,619 and 2,979,528, which are incorporated herein by reference.

The reaction between the carboxylic agent and the amine- or hydroxy-terminated polyoxyalkylene can be carried out at a temperature ranging from the highest of the melt temperatures of the reaction components up to the lowest of the decomposition temperatures of the reaction components or products. Generally, the reaction is carried out at a temperature in the range of about 60° C. to about 160° C., preferably about 120° C. to about 160° C. The ratio of equivalents of carboxylic agent to polyoxyalkylene preferably ranges from about 0.1:1 to about 8:1, preferably about 1:1 to about 4:1, and advantageously about 2:1. The weight of an equivalent of the carboxylic agent can be determined by dividing its molecular weight by the number of carboxylic functions present. The weight of an equivalent of the amine-terminated polyoxyalkylene can be determined by dividing its molecular weight by the number of terminal amine groups present. The weight of an equivalent of the hydroxyterminated polyoxyalkylene can be determined by dividing its molecular weight by the number of terminal terminal hydroxyl groups present. The number of terminal amine and hydroxyl groups can usually be determined from the structural formula of the polyoxyalkylene or empirically through well known procedures. The amide/acids and ester/acids formed by the reaction of the carboxylic agent and amine-terminated or hydroxy-terminated polyoxyalkylene can be neutralized with, for example, one or more alkali metals, one or more amines, or a mixture thereof, and thus converted to amide/salts or ester/salts, respectively. Additionally, if these amide/acids or ester/acids are added to concentrates or functional fluids containing alkali metals or amines, amide/salts or ester/salts usually form, in situ.

U.S. Pat. No. 4,659,492 is incorporated herein by reference for its teachings with respect to the use of hydrocarbyl-substituted succinic acid or anhydride/hydroxy-terminated poly(oxyalkylene) reaction products as thickeners for aqueous compositions.

When the thickener is formed using an amine-terminated poly(oxyalkylene), the thickening characteristics of said thickener can be enhanced by combining it with at least one surfactant. Any of the surfactants identified above under the subtitle "Surfactants" can be used in this regard. When such surfactants are used, the weight ratio of thickener to surfactant is generally in the range of from about 1:5 to about 5:1, preferably from about 1:1 to about 3:1.

Typically, the thickener is present in a thickening amount in the aqueous compositions of this invention. When used, the thickener is preferably present at a level of up to about 70% by weight, preferably from about 20% to about 50% by weight of the concentrates of the invention. The thickener is preferably present at a level in the range of from about 1.5% to about 10% by weight, preferably from about 3% to about 6% by weight of the functional fluids of the invention.

FUNCTIONAL ADDITIVES

The functional additives that can be used in the aqueous systems are typically oil-soluble, water-insoluble additives which function in conventional oil-based systems as extreme pressure agents, anti-wear agents, load-carrying agents, dispersants, friction modifiers, lubricity agents, etc. They can also function as anti-slip agents, film formers and friction modifiers. As is well known, such additives can function in two or more of the above-mentioned ways; for example, extreme pressure agents often function as loadcarrying agents.

The term "oil-soluble, water-insoluble functional additive" refers to a functional additive which is not soluble in water above a level of about 1 gram per 100 milliliters of water at 25° C., but is soluble in mineral oil to the extent of at least 1 gram per liter at 25° C.

These functional additives can also include certain solid lubricants such as graphite, molybdenum disulfide and polytetrafluoroethylene and related solid polymers.

These functional additives can also include frictional polymer formers. Briefly, these are potential polymer forming materials which are dispersed in a liquid carrier at low concentration and which polymerize at rubbing or contacting surfaces to form protective polymeric films on the surfaces. The polymerizations are believed to result from the heat generated by the rubbing and, possibly, from catalytic and/or chemical action of the freshly exposed surface. A specific example of such materials is dilinoleic acid and ethylene glycol combinations which can form a polyester frictional polymer film. These materials are known to the art and descriptions of them are found, for example, in the journal "Wear", Volume 26, pages 369-392, and West German Published Patent Application 2,339,065. These disclosures are hereby incorporated by reference for their discussions of frictional polymer formers.

Typically these functional additives are known metal or amine salts of organo sulfur, phosphorus, boron or carboxylic acids which are the same as or of the same type as used in oil-based fluids. Typically such salts are of carboxylic acids of 1 to 22 carbon atoms including both aromatic and aliphatic acids; sulfur acids such as alkyl and aromatic sulfonic acids and the like; phosphorus acids such as phosphoric acid, phosphorus acid, phosphinic acid, acid phosphate esters and analogous sulfur homologs such as the thiophosphoric and dithiophosphoric acid and related acid esters; boron acids include boric acid, acid borates and the like. Useful functional additives also include metal dithiocarbamates such as molybdenum and antimony dithiocarbamates; as well as dibutyl tin sulfide, tributyl tin oxide, phosphates and phosphites; borate amine salts, chlorinated waxes; trialkyl tin oxide, molybdenum phosphates, and chlorinated waxes.

Many such functional additives are known to the art. For example, descriptions of additives useful in conventional oil-based systems and in the aqueous systems of this invention are found in "Advances in Petroleum Chemistry and Refining", Volume 8, edited by John J. McKetta, Interscience Publishers, New York, 1963, pages 31-38 inclusive; Kirk-Othmer "Encyclopedia of Chemical Technology", Volume 12, Second Edition, Interscience Publishers, New York, 1967, page 575 et seq.; "Lubricant Additives" by M. W. Ranney, Noyes Data Corporation, Park Ridge, N.J., U.S.A., 1973; and "Lubricant Additives" by C. V. Smalheer and R. K. Smith, The Lezius-Hiles Co., Cleveland, Ohio, U.S.A. These references are hereby incorporated by reference for their disclosures of functional additives useful in the compositions of this invention.

In certain of the typical aqueous compositions of the invention, the functional additive is a sulfur or chlorosulfur extreme pressure agent, known to be useful in oil-base systems Such materials include chlorinated aliphatic hydrocarbons, such as chlorinated wax; organic sulfides and polysulfides, such as benzyl-disulfide, bis-(chlorobenzyl)disulfide, dibutyl tetrasulfide, sulfurized sperm oil, sulfurized methyl ester of oleic acid, sulfurized alkylphenol, sulfurized dipentene, sulfurized terpene, and sulfurized Diels-Alder adducts; phosphosulfurized hydrocarbons, such as the reaction product of phosphorus sulfide with turpentine or methyl oleate; phosphorus esters such as the dihydrocarbon and trihydrocarbon phosphites, i.e., dibutyl phosphite, diheptyl phosphite, dicyclohexyl phosphite, pentylphenyl phosphite, dipentylphenyl phosphite, tridecyl phosphite, distearyl phosphite and polypropylene substituted phenol phosphite; metal thiocarbamates, such as zinc dioctyldithiocarbamate and barium heptylphenol dithiocarbamate; and Group II metal salts of a phosphorodithioic acid, such as zinc dicyclohexyl phosphorodithioate.

The functional additive can also be a film former such as a synthetic or natural latex or emulsion thereof in water. Such latexes include natural rubber latexes and polystyrene butadienes synthetic latex.

The functional additive can also be an anti-chatter or anti-squawk agent. Examples of the former are the amide metal dithiophosphate combinations such as disclosed in West German Patent 1,109,302; amine salt-azomethene combinations such as disclosed in British Patent Specification 893,977; or amine dithiophosphate such as disclosed in U.S. Pat. No. 3,002,014. Examples of anti-squawk agents are N-acyl-sarcosines and derivatives thereof such as disclosed in U.S. Pat. Nos. 3,156,652 and 3,156,653; sulfurized fatty acids and esters thereof such as disclosed in U.S. Pat. Nos. 2,913,415 and 2,982,734; and esters of dimerized fatty acids such as disclosed in U.S. Pat. No. 3,039,967. The above-cited patents are incorporated herein by reference for their disclosure as pertinent to anti-chatter and anti-squawk agents useful as a functional additive in the aqueous systems of the present invention.

Mixtures of two or more of any of the afore-described functional additives can also be used.

Typically, a functionally effective amount of the functional additive is present in the aqueous compositions of this invention.

The term "functionally effective amount" refers to a sufficient quantity of an additive to impart desired properties intended by the addition of said additive. For example, if an additive is a rust-inhibitor, a functionally effective amount of said rust-inhibitor would be an amount sufficient to increase the rust-inhibiting characteristics of the composition to which it is added. Similarly, if the additive is an anti-wear agent, a functionally effective amount of said anti-wear agent would be a sufficient quantity of the anti-wear agent to improve the anti-wear characteristics of the composition to which it is added.

The aqueous systems of this invention often contain at least one optional inhibitor for corrosion of metals. These inhibitors can prevent corrosion of either ferrous or non-ferrous metals (e g., copper, bronze, brass, titanium, aluminum and the like) or both. The optional inhibitor can be organic or inorganic in nature. Usually it is sufficiently soluble in water to provide a satisfactory inhibiting action though it can function as a corrosion- inhibitor without dissolving in water, it need not be water-soluble. Many suitable inorganic inhibitors useful in the aqueous systems of the present invention are known to those skilled in the art. Included are those described in "Protective Coatings for Metals" by Burns and Bradley, Reinhold Publishing Corporation, Second Edition, Chapter 13, pages 596–605. This disclosure relative to inhibitors are hereby incorporated by reference. Specific examples of useful inorganic inhibitors include alkali metal nitrites, sodium di- and tripolyphosphate, potassium and dipotassium phosphate, alkali metal borate and mixtures of the same. Many suitable organic inhibitors are known to those of skill in the art. Specific examples include hydrocarbyl amine and hydroxy-substituted hydrocarbyl amine neutralized acid compound, such as neutralized phosphates and hydrocarbyl phosphate esters, neutralized fatty acids (e.g., those having about 8 to about 22 carbon atoms), neutralized aromatic carboxylic acids (e.g., 4-tertiarybutyl benzoic acid), neutralized naphthenic acids and neutralized hydrocarbyl sulfonates. Particularly useful amines include the alkanol amines such as ethanol amine, diethanolamine. Mixtures of two or more of any of the afore-described corrosion-inhibitors can also be used. The corrosion-inhibitor is usually present in concentrations in which they are effective in inhibiting corrosion of metals with which the aqueous composition comes in contact.

The aqueous systems of the present invention can also include at least one bactericide. Such bactericides are well known to those of skill in the art and specific examples can be found in the afore-mentioned McCutcheon publication "Functional Materials" under the heading "Antimicrobials" on pages 9–20 thereof. This disclosure is hereby incorporated by reference as it relates to suitable bactericides for use in the aqueous compositions or systems of this invention. Generally, these bactericides are water-soluble, at least to the extent to allow them to function as bactericides.

The aqueous systems of the present invention can also include such other materials as dyes, e.g., an acid green dye; water softeners, e.g., ethylene diamine tetraacetate sodium salt or nitrilo triacetic acid; odor masking agents, e.g., citronella, oil of lemon, and the like; and anti-foamants, such as the well-known silicone anti-foamant agents.

The aqueous systems of this invention may also include an anti-freeze additive where it is desired to use the composition at a low temperature. Materials such as ethylene glycol and analogous polyoxyalkylene polyols can be used as anti-freeze agents. Clearly, the amount used will depend on the degree of anti-freeze protection desired and will be known to those of ordinary skill in the art.

It should also be noted that many of the ingredients described above for use in making the aqueous systems of this invention are industrial products which exhibit or confer more than one property on such aqueous compositions. Thus, a single ingredient can provide several functions thereby eliminating or reducing the need for some other additional ingredient. Thus, for example, an extreme pressure agent such as tributyl tin oxide can also function as a bactericide.

Table 1 contains the formulations for examples 1–6 of useful corrosion inhibiting compositions.

TABLE 1

| | 1 | 2 | 3 | 4 | 5 | 6 |
|---|---|---|---|---|---|---|
| Alkaterge T (product of Argus Chemical identified as 2-(8-heptadecenyl)-4,4-bis(hydroxy-methyl)-2-oxazoline) | 50% | 33.3% | 33.3% | 25% | 50% | 30% |
| Dodecanedioic Acid | 50% | 33.3% | 33.3% | 50% | 25% | 30% |
| Sodium Sarcosinate | — | 33.3% | — | 25% | — | 40% |
| Sarcosine | — | — | 33.3% | — | 25% | — |

All percentages are in weight percent.

Table 2 contains the formulations for aqueous concentrates 7, 8 and 9.

TABLE 2

| | 7 | 8 | 9 |
|---|---|---|---|
| Reaction product of polyisobutenyl (number average molecular weight of 950) succinic anhydride and diethylethanolamine (33% by weight 40 neutral hydrotreated naphthenic oil) | 14.50 | 14.50 | 14.50 |
| DEA (diethanolamine) | 11.33 | — | 4.31 |
| TEA (triethanolamine) | — | 11.33 | — |
| MEA (monoethanolamine) | 1.00 | 1.00 | 6.02 |
| Unitol DT-40 (product of Union Camp identified as a distilled tall oil having a monomeric fatty acid content of 40% by weight, a dimerized fatty acid content of 11% by weight, an esterified fatty acid content of 7% by weight, a rosin acid content of about 40% by weight, and 2% by weight unsaponifiables) | 1.57 | 1.57 | 1.57 |
| Ethomeen C/25 (product of Armak identified as a condensation product of a primary amine with ethylene oxide) | 2.06 | 2.06 | 2.06 |
| Alkaterge T | 1.00 | 1.00 | 1.00 |
| Dodecanedioic Acid | 1.00 | 1.00 | 1.00 |
| Na-Sarcosinate (40% in $H_2O$) | 2.50 | 1.25 | — |
| An ester-salt of a $C_{16}$ substituted succinic anhydride and dimethylethanol amine | — | — | 1.00 |
| Water | 62.68 | 63.93 | 66.18 |
| Zinc salt of dimethyl amyl dithiophosphoric acid | 2.16 | 2.16 | 2.16 |

TABLE 2-continued

| | 7 | 8 | 9 |
|---|---|---|---|
| Foamban MS-30 (product of Ultra Adhesives identified as a silicon defoamer) | 0.20 | 0.20 | 0.20 |
| Total | 100.00 | 100.00 | 100.00 |

Examples 7 and 8 in Tables 2 were tested in the ASTM 665 (turbine oil rust) test, DIN 51360 (part I) and hard water stability test.

ASTM 665 measures the rust on a special cylindrical steel test specimen made from number 1018 cold finish carbon steel. Immerse the specimen for 24 hours at 60° C. in a mixture of 2% of the example 7 or 8 in 0.05 normal saline solution. After the 24 hour period, remove, wash and rate the specimen for rust.

DIN-51360 (Part I) measures the rust and staining on a cast iron plate. Divide the plate into 4 sections. Place two grams of steel chips in each section of the plate along with two milliters of a fluid prepared from the 5% of example 7 or 8 mixed with water having 359 parts per million hardness. Prepare the hard water by mixing 663 mg/l $CaCl_2.6H_2O$; and 134 mg/l $MgSO_4.7H_2O$, with distilled water. Place the plate into a humidity cabinet maintained at 18.5° C. and at 52% humidity for 24 hours. After the 24 hours, remove and discard the steel chips. Rate the iron plate for pits, stains and stain intensities. The test reports the number of pits; test area stained; and stain intensity. A pass rating would be a plate having only traces of the area stained and trace stain intensity.

Establish hard water stability of various compositions of the present invention by testing the stability of the emulsion at 2% and 5% of the example 7 or 8 in 1500 parts per million hard water for 8 days at 70° C. Prepare the hard water by mixing with distilled water 801 mg/l $CaSO_4.2H_2O$, 2,545 mg/l $MgSO_4.7H_2O$ and 494 mg/l NaCl. At the end of the time period measure the amount of the emulsion remaining.

Table 3 represents testing results in the above-described tests of Examples 7 and 8.

TABLE 3

| | D-665 | DIN-51360 (Part I) | Hard Water Stability |
|---|---|---|---|
| Example 7 | pass | pass (4/4) | pass |
| Example 8 | pass | pass (3/4) | pass |

As can be seen from Table 3, example 7 passed both the spindle rust test, the hard water stability test and passed the DIN-51360 (Part I) in all four quadrants. Example 8 passed all tests and showed a pass rating in three of four quadrants.

As can be seen from Table 3, the aqueous functional fluids containing the corrosion inhibitors described above provide effective corrosion and rust inhibition to functional fluid while still maintaining stability in hard waters even those having 1500 parts per million.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

We claim:

1. A composition comprising:

(A) at least one dicarboxylic acid or anhydride or ammonium or metal salt of the dicarboxylic acid or anhydride; and (B) at least one compound represented by the formula

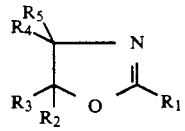

wherein $R_2$, $R_3$, $R_4$ and $R_5$ are each independently hydrogen, alkyl, hydroxyalkyl, polyhydroxyalkyl, polyalkoxyalkyl or hydroxypolyalkoxyalkyl; and $R_1$ is a hydrocarbyl group; and (E) water containing greater than 100 ppm hardness.

2. The composition of claim 1 wherein $R_2$, $R_3$, $R_4$ and $R_5$ are each independently hydrogen, hydroxyalkyl or alkyl.

3. The composition of claim 1 wherein $R_2$, $R_3$, $R_4$ and $R_5$ are each independently hydrogen or hydroxyalkyl containing 1 to about 6 carbon atoms or alkyl containing 1 to about 12 carbon atoms.

4. The composition of claim 1 wherein $R_4$ and $R_5$ are each independently hydrogen, hydroxymethyl, hydroxyethyl or hydroxypropyl.

5. The composition of claim 1 wherein $R_1$ is an alkyl group, an alkenyl group, an aryl group or an arylalkyl group, and $R_1$ contains from 1 to about 28 carbon atoms.

6. The composition of claim 1 wherein $R_1$ is an alkyl or alkenyl group and $R_1$ contains from about 6 to about 20 carbon atoms.

7. The composition of claim 1 wherein the dicarboxylic acid comprises at least one saturated or unsaturated aliphatic acid or anhydride; or at least one aromatic acid or anhydride.

8. The composition of claim 1 wherein the dicarboxylic acid has from about 4 to about 24 carbon atoms.

9. The composition of claim 1 wherein the ammonium salt of the acid is derived from ammonia, at least one monoamine or at least one polyamine.

10. The composition of claim 1 wherein the ammonium salt of the acid is derived from at least one alkanolamine, pyridine, morpholine, piperadine, or alkyl monoamine.

11. The composition of claim 1 wherein the ammonium salt of the acid is derived from diethanolamine, triethanolamine, the butylamine, or methyl morpholine.

12. The composition of claim 1 wherein the ammonium salt of the acid is derived from at least one polyalkylene polyamine, hydroxy polyalkylene polyamine or heterocyclic polyamine.

13. The composition of claim 1 wherein the the metal salt of the acid is derived from at least one alkali or alkaline earth metal compound.

14. The composition of claim 1 wherein the metal salt of the acid is derived from at least one sodium, potassium, lithium, and magnesium compound.

15. The composition of claim 1 further comprising:

(C) at least one acid, or ammonium or metal salt of the acid represented by the formula:

(II)

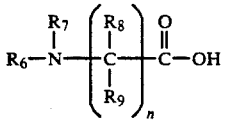

wherein $R_6$, $R_7$, $R_8$ and $R_9$ are each independently hydrogen or hydrocarbyl groups; and n is a number from 1 to about 10; or (D) at least one ester-salt derived from at least one alkyl or alkenyl succinic acid or anhydride having about 8 to about 28 carbon atoms and at least one alkanol amine;

or mixtures of (C) and (D).

16. The composition of claim 15 wherein $R_6$ and $R_7$ are each independently hydrogen or alkyl groups containing from 1 to about 20 carbon atoms.

17. The composition of claim 15 wherein $R_6$ and $R_7$ are each independently hydrogen or alkyl groups containing from 1 to about 6 carbon atoms.

18. The composition of claim 15 wherein $R_8$ and $R_9$ are each independently hydrogen or alkyl groups containing from 1 to about 6 carbon atoms.

19. The composition of claim 15 wherein $R_8$ and $R_9$ are each independently hydrogen, methyl or ethyl.

20. The composition of claim 15 wherein the ammonium salt of the acid is derived from ammonia, at least one monoamine or at least one polyamine.

21. The composition of claim 15 wherein the ammonium salt of the acid is derived from at least one alkanolamine, pyridine, morpholine, piperadine, or alkyl monoamine.

22. The composition of claim 15 wherein the ammonium salt of the acid is derived from diethanolamine, triethanolamine, the butylamine, or methyl morpholine.

23. The composition of claim 15 wherein the ammonium salt of the acid is derived from at least one polyalkylene polyamine, hydroxy polyalkylene polyamine or heterocyclic polyamine.

24. The composition of claim 15 wherein the the metal salt of the acid is derived from at least one alkali or alkaline earth metal compound.

25. The composition of claim 15 wherein the metal salt of the acid is derived from at least one sodium, potassium, lithium, and magnesium compound.

26. The composition of claim 15 wherein the succinic anhydride or acid of (D) contains from about 10 to about 20 carbon atoms.

27. The composition of claim 15 wherein the ester-salt of (D) is derived from dimethylethanolamine, diethylethanolamine, methylethylethanolamine or monoethanolamine.

28. The composition of claim 15 wherein the ratio of (A):(B) is from about (3:1) to about (1:3) by weight.

29. The composition of claim 15 wherein the ratio of (A):(C or D) is from about (1:3) to about (3:1) by weight and the ratio of (B):(C or D) is from about (1:3) to about (3:1) by weight.

30. A composition, comprising:

A) at least one saturated or unsaturated aliphatic dicarboxylic acid having from about 10 to about 14 carbon atoms;

B) at least one compound represented by the formula:

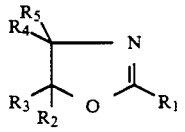

wherein $R_2$ and $R_3$ are each independently hydrogen, methyl or ethyl; $R_4$ and $R_5$ are each independently hydrogen, hydroxymethyl or hydroxyethyl; and $R_1$ is alkenyl or alkyl having from about 16 to about 18 carbon atoms; and (C) at least one acid, or ammonium or metal salt of the acid, represented by the formula

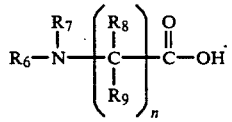

wherein $R_6$, $R_7$, $R_8$ and $R_9$ are each independently hydrogen or alkyl having from 1 to about 6 carbon atoms; n is 1; or (D) at least one ester-salt derived from at least alkyl or alkenyl succinic anhydride having from about 14 to about 18 carbon atoms and dimethylethanolamine; or mixtures of (C) and (D).

31. The composition of claim 30 further comprising (C) and (D).

32. A functional fluid comprising:

water and a corrosion-inhibiting amount of the composition of claim 1 dispersed in the water.

33. A functional fluid comprising:

water and a corrosion-inhibiting amount of the composition of claim 15 dispersed in the water.

34. A functional fluid comprising:

water and a corrosion-inhibiting amount of the composition of claim 30 dispersed in the water.

35. The fluid of claim 32, wherein the fluid comprises from about 0.01% to about 0.15% by weight of (A) and (B).

36. The fluid of claim 33, wherein the fluid comprises from about 0.01% to about 0.15% by weight of (A) and (B); and up to about 0.15% by weight of (C) and (D).

37. The fluid of claim 34, wherein the fluid comprises from about 0.01% to about 0.15% by weight of each of (A) and (B); up to 0.15% weight of each of (C) and (D).

38. A concentrate comprising at least one diluent and from about 0.2% to about 3% by weight of the composition of claim 1.

39. A concentrate comprising at least one diluent and from about 0.2% to about 3% by weight of the composition of claim 15.

40. A concentrate comprising at least one diluent and from about 0.2% to about 3% by weight of the composition of claim 30.

41. A method of inhibiting corrosion of metal parts in a hydraulic system employing a functional fluid comprising adding to the functional fluid a corrosion inhibiting amount of the composition of claim 1.

42. A method of inhibiting corrosion of metal parts in a hydraulic system employing a functional fluid comprising adding to the functional fluid a corrosion inhibiting amount of the composition of claim 15.

43. A method of inhibiting corrosion of metal parts in a hydraulic system employing a functional fluid comprising adding to the functional fluid a corrosion inhibiting amount of the composition of claim 30.

44. The composition of claim 1 wherein (A) and (B) are dispersed in water having hardness greater than 200 ppm.

45. The composition of claim 44 wherein the water hardness is greater than 250 ppm and less than 3,000 ppm.

46. The composition of claim 30 wherein components (A), (B) and at least one of (C) or (D) are dispersed in water having a hardness of greater than 200 ppm.

47. The composition of claim 46 wherein the water hardness is between 250 ppm and 3,000 ppm.

* * * * *